United States Patent [19]

Gageur

[11] 4,347,960

[45] Sep. 7, 1982

[54] APPARATUS FOR LOADING RUNS OF FABRICS

[75] Inventor: Fritz Gageur, Lindau-Bodolz, Fed. Rep. of Germany

[73] Assignee: Hoechst Aktiengesellschaft, Fed. Rep. of Germany

[21] Appl. No.: 218,365

[22] Filed: Dec. 19, 1980

[30] Foreign Application Priority Data

Feb. 29, 1980 [DE] Fed. Rep. of Germany ..... 3007752

[51] Int. Cl.[3] ..... B65H 25/06; B65H 17/32

[52] U.S. Cl. ..... 226/97

[58] Field of Search ..... 226/95, 97, 7; 34/57 R, 34/57 A, 156, 155

[56] References Cited

U.S. PATENT DOCUMENTS

| | | | |
|---|---|---|---|
| 4,197,973 | 4/1980 | Daane | 226/97 |
| 4,201,323 | 5/1980 | Stibbe et al. | 226/97 |
| 4,274,210 | 6/1981 | Stengard | 34/156 |
| 4,290,210 | 9/1981 | Johansson | 34/156 |

*Primary Examiner*—Leonard D. Christian

*Attorney, Agent, or Firm*—James E. Bryan

[57] ABSTRACT

This invention relates to equipment for loading runs of fabrics with a gaseous treatment medium and being composed of nozzle boxes sequentially arrayed in the direction of advance of the run of material and extending transversely thereto, the boxes being supplied with the treatment medium which is blown out from orifices located therein against the material, a covering means mounted in each nozzle box above a slotted discharge nozzle and being of such a design that the covering means has a wavy profiled surface extending longitudinally parallel to the direction of jet and parallel to the longitudinal direction of the discharge nozzle, the wavy profiled surface forming a number of stop apertures above the discharge nozzle and perpendicularly thereto, the improvement comprising upper and lower partition means covering ends of the covering means which point toward side walls of the nozzle box, whereby the nozzle box is divided into an upper and a lower barrier space with the latter including at least one discharge nozzle, the upper partition means covering ends of the wavy profiled surface of the covering means open toward the upper barrier space, and the lower partition means covering an area extending beyond the ends and toward the center of the nozzle box of the covering means which is open toward the lower barrier space and the discharge nozzle, the partition means between walls of the nozzle box and the ends of the covering means forming lateral channels which connect the surfaces of the covering means which are open toward the upper and lower barrier spaces.

2 Claims, 2 Drawing Figures

APPARATUS FOR LOADING RUNS OF FABRICS

Figure 1:
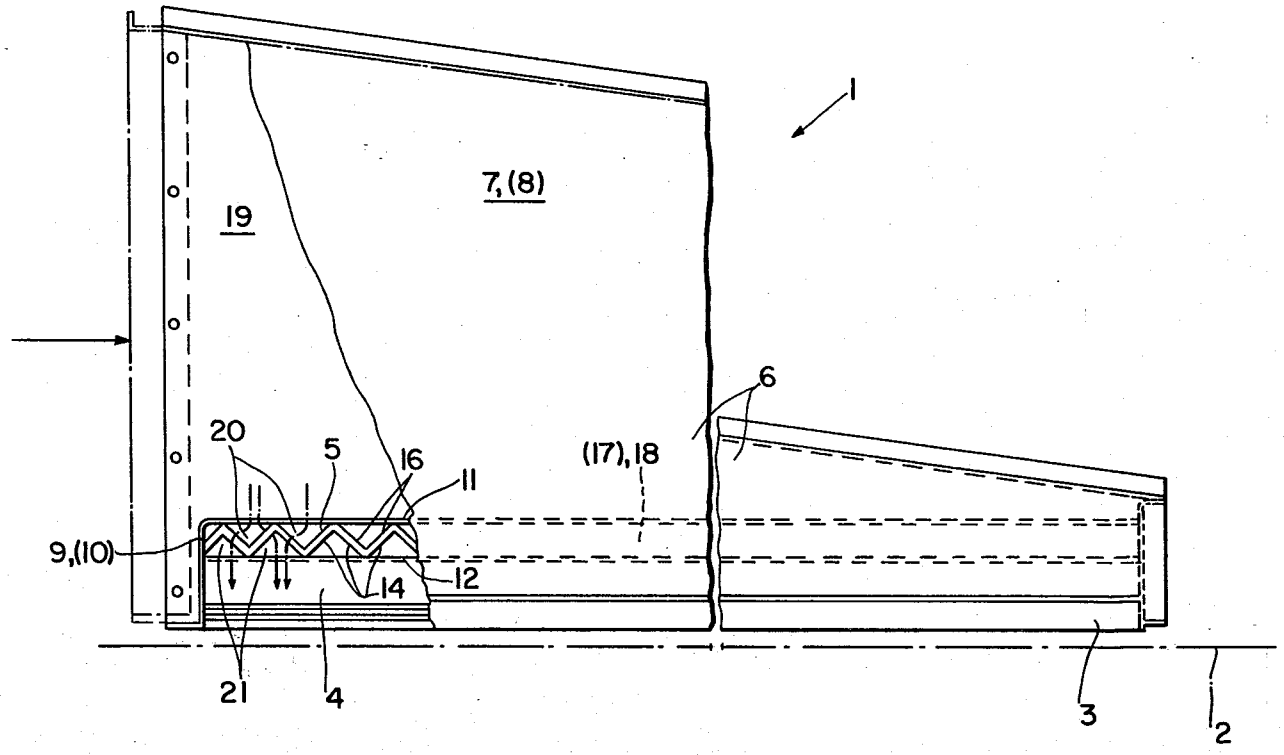

This invention relates to equipment for loading runs of fabrics with a gaseous treatment medium and is composed of nozzle boxes sequentially arrayed in the direction of motion of the run of material and transverse thereto, the treatment medium being fed to the nozzle boxes and blown from apertures therein against the run, a covering means being mounted in each nozzle box above a slotted discharge nozzle and being of such a design that its contour parallel to the jet direction and parallel to the longitudinal direction of the discharge nozzle is of a wavy shape, forming a number of stop apertures over the discharge nozzle and perpendicularly thereto.

In an air or gas nozzle designed as a simple hole in a plane surface and known from German Offenlegungsschrift No. 2,502,647, a gas flow is made to pass along one side of the surface and nearly parallel thereto, and is thus supplied to the nozzle, which comprises as its edge facing the gas flow a recoil surface penetrating the flow. The system is so designed that the gas flow fed approximately parallel to the nozzle surface will be deflected at the recoil surface into a direction nearly perpendicular to the nozzle surface. In another nozzle arrangement known from German Offenlegungsschrift No. 2,555,287 for loading runs of fabrics, the gaseous treatment medium is applied to the fabrics from a number of nozzle boxes consecutive in the direction of motion of the runs and transverse thereto, the boxes being supplied laterally and the gaseous treatment medium being blown from the boxes through nozzle or stop apertures perpendicularly against the run of fabric. A barrier means is mounted in front of each blow aperture.

Another arrangement for loading runs of fabrics with a gaseous treatment medium and known from German Auslegeschrift No. 2,733,347 is composed of nozzle boxes sequentially arrayed in the direction of motion of the run of material and also transverse thereto, the boxes being fed laterally with the treatment medium which is blown from apertures in the boxes against the run of fabric. An easily exchanged covering means is provided to that end in each nozzle box above a slotted discharge nozzle, the covering means being of such a design that it has a wavy contour in a cross-section in a plane parallel to the direction of the jet in the discharge nozzle and parallel to the longitudinal direction of the discharge nozzle. The covering means extends in the longitudinal direction of the discharge nozzle, whereby a number of stop apertures are formed over the discharge nozzle and perpendicularly thereto.

All of these known arrangements have been found disadvantageous both as regards the location of the recoil means and baffles or barriers in front of the discharge apertures or slotted nozzles and the location of a covering means directly over or behind the discharge nozzles or slots on account of the less than optimal flow conditions so obtained for the gas flow, whether incident, passing by or flowing through. The turbulences nevertheless occurring when the gas flows out of the blow apertures or nozzles or slots onto the run of fabric to be treated result in a non-uniform surface effect. Accordingly lengths of materials, especially highly delicate ones (for instance very thin foils) will undergo qualitative degradation.

This being the state of the art, it is the object of the invention to so improve the flow conditions by arranging guidance and flow improving means within the nozzle boxes and especially in front of the discharge apertures or nozzle(s), that the gas jet loading the run of fabric flows or is guided at even pressure conditions perpendicularly to, and without shadow effects (flow shadows), and without turbulences, against the surface of the run of fabric.

The advantage of the invention is especially that by dividing the nozzle box into two barrier spaces, one above the other, located above and below a corrugated covering means and using partitions partly covering these, the flow conditions from the upper to the lower barrier space are stabilized. Hence, the discharge of the gas jet at the exhaust aperture or nozzle will be optimal with respect to the surface of the run of material.

This stabilization of the flow conditions is especially achieved by the channelling formed by the partitions at the ends of the covering means and with the ensuing multiple deflection of the flowing medium from the upper into the lower barrier space. The gaseous treatment medium bounded sideways by the walls of the nozzle box and the corrugated profile of the covering means, which is open from its surface toward the upper barrier space, flows through the orifices formed by the ends of the profiled surface and the upper partitions into adjoining channels from whence it passes through orifices formed by the lower partitions and the profiled surface into the lower barrier space formed by the side walls and the discharge orifices. The flow conditions are so optimized by the reversal or deflection constrained by the lateral channel guidance in the direction of flow that the treatment medium issues without any disturbance, vertically uniformly and without shadow effects and arrives thus on the surface of the run of fabric to be treated. The discharge cross-section can be adjusted by a control or regulating means mounted at the discharge orifice or nozzle, respectively, and in this manner the issued gas jet can be metered.

An illustrative embodiment is described below and explained in relation to the accompanying drawings.

Figure 2:
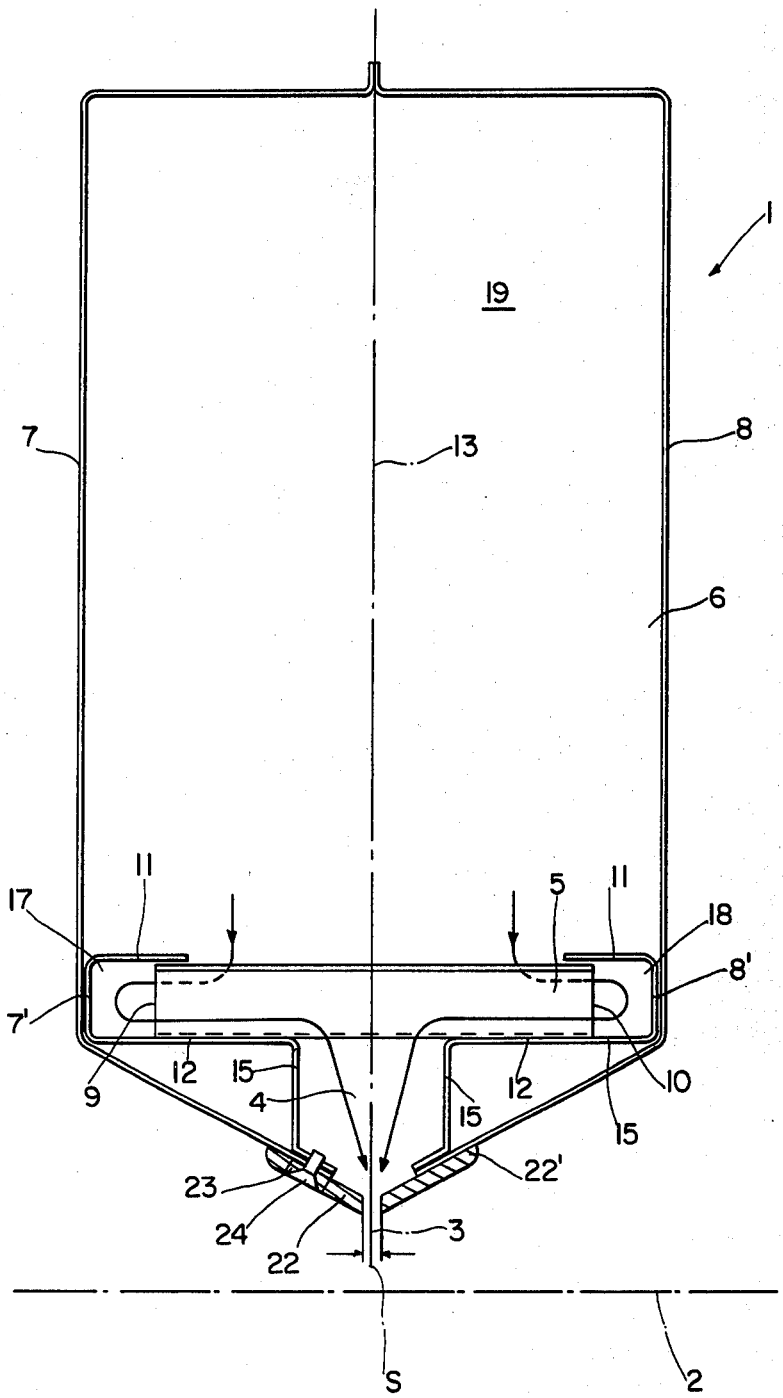

FIG. 1 is a longitudinal section of a nozzle box with upper and lower barrier spaces, and FIG. 2 is a cross-section of the nozzle box of FIG. 1.

A nozzle box 1 shown schematically and partially in FIGS. 1 and 2, tapering from left to right in FIG. 1, is provided at its lower side with a discharge nozzle 3 pointing at the run of fabric 2. A lower barrier space 4 is located above the discharge nozzle 3 above which extends a zig-zag shaped or corrugated or similarly profiled covering means 5, above which in turn is located an upper barrier space 6. The ends 9, 10 (FIG. 2) of the profiled covering 5 pointing toward the side walls 7, 8 of the nozzle box 1 are partially covered by an upper and a lower partition 11, 12. The lower partition 12, which covers more the ends 9, 10 of the profiled covering 5 toward the center 13 (FIG. 2) of the nozzle box 1, together with a lower zig-zag shaped or corrugated lower profiled surface 14 (FIG. 1) of the profiled covering 5 at the same time is the upper and sideways boundary wall 15 of the lower barrier space 4. The upper partition 11 on the other hand rests only on the edge of the ends 9, 10 of the profiled covering 5, and together with its upwardly open corrugated profile surface 16 bounds the upper barrier space 6. Together with the lower and upper profiled surfaces 14, 16 of the profiled covering 5, the partitions 11,12 form lateral channels 17, 18 between the ends of the covering and the wall components of the side walls 7, 8 of the nozzle box 1, or the partitions 7', 8' mounted therein.

A gaseous treatment medium 19 pressurized in the upper barrier space 6 and relatively uniformly distributed therein and discharging against the upper profiled surface 16 flows through the orifices 20 (FIG. 1) formed at the ends 9, 10 of the profiled covering 5 by its upper profiled surface 16 and the upper partition 11 into the channels 17, 18 formed to the side by the upper partition 11, the side wall and the lower partition 12, thereupon flowing back into neighboring orifices 21 formed by the lower profiled surface 14 and the lower partition 12, whereupon after again charging the direction of flow, the gaseous medium arrives at the lower barrier space 4 (see flow arrows). On account of this four-fold change in direction of flow, and the barrier space 4 mounted in front of the discharge nozzle 3, it is now possible to blow or make the treatment medium 19 flow in a fully uniform manner, free from any turbulence, at constant pressure, without shadow effects or formation, vertically toward the surface of the run of material 2 passing underneath.

The discharge cross-section, i.e. the slot "s" of the discharge nozzle 3, can be adjusted by setting members 22, 22', for instance an elongated slot 23 with screw 24, located at the lower side of the barrier space 4.

It will be obvious to those skilled in the art that many modifications may be made within the scope of the present invention without departing from the spirit thereof, and the invention includes all such modifications.

What I claim is:

1. In equipment for loading runs of fabrics with a gaseous treatment medium and being composed of nozzle boxes sequentially arrayed in the direction of advance of the run of material and extending transversely thereto, said boxes being laterally supplied with the treatment medium which is blown out from orifices located therein against the run of material, a covering means being mounted in each nozzle box above a slotted discharge nozzle and being of such a design that the covering means has a wavy profiled surface extending longitudinally parallel to the direction of jet and parallel to the longitudinal direction of the discharge nozzle, said wavy profiled surface forming a number of stop apertures above the discharge nozzle and perpendicularly thereto, the improvement comprising upper and lower partition means covering ends of said covering means which point toward side walls of said nozzle box, whereby said nozzle box is divided into an upper and a lower barrier space with the latter including at least one discharge nozzle, said upper partition means covering ends of the wavy profiled surface of said covering means open toward said upper barrier space, and said lower partition means covering an area extending beyond the ends and toward the center of the nozzle box of the wavy profiled surface of said covering means which is open toward the lower barrier space and the discharge nozzle, said partition means between walls of the nozzle box and the ends of said covering means forming lateral channels which connect the wavy profiled surfaces of said covering means which are open toward said upper and lower barrier spaces.

2. Equipment according to claim 1 including means whereby the slot cross-section of the discharge nozzle located in the lower barrier space is adjustable.

* * * * *

UNITED STATES PATENT AND TRADEMARK OFFICE

CERTIFICATE OF CORRECTION

PATENT NO. : 4,347,960

DATED : September 7, 1982

INVENTOR(S) : Fritz Gageur

It is certified that error appears in the above—identified patent and that said Letters Patent is hereby corrected as shown below:

On the title page

Item [73], the Assignee should be - - - LINDAUER DORNIER GESELLSCHAFT mbH. - - -.

Column 3, line 13, "charging" should read - - - changing - - -.

Signed and Sealed this

*Twenty-fourth* Day of *May 1983*

[SEAL]

*Attest:*

DONALD J. QUIGG

*Attesting Officer*

*Acting Commissioner of Patents and Trademarks*